US011585629B2

(12) United States Patent
Hilt

(10) Patent No.: US 11,585,629 B2
(45) Date of Patent: Feb. 21, 2023

(54) THREE-IN-ONE TOY PROJECTILE LAUNCHING ASSEMBLY

(71) Applicant: Garrett Hilt, Bakersfield, CA (US)

(72) Inventor: Garrett Hilt, Bakersfield, CA (US)

( * ) Notice: Subject to any disclaimer, the term of this patent is extended or adjusted under 35 U.S.C. 154(b) by 0 days.

(21) Appl. No.: 17/713,594

(22) Filed: Apr. 5, 2022

(65) Prior Publication Data

US 2022/0226745 A1 Jul. 21, 2022

Related U.S. Application Data

(63) Continuation of application No. 17/111,460, filed on Dec. 3, 2020, now Pat. No. 11,325,051.

(51) Int. Cl.

| | |
|---|---|
| ***F41B 5/00*** | (2006.01) |
| ***F41B 11/642*** | (2013.01) |
| ***F41B 11/89*** | (2013.01) |
| ***F41B 7/08*** | (2006.01) |
| *F42B 6/10* | (2006.01) |
| *F42B 6/02* | (2006.01) |

(52) U.S. Cl.

CPC ..... *F41B 11/89* (2013.01); *F41B 7/08* (2013.01); *F41B 11/642* (2013.01); *F42B 6/02* (2013.01); *F42B 6/10* (2013.01)

(58) Field of Classification Search

CPC ..... F41B 5/00; F41B 5/14; F41B 7/08; F41B 11/642; F41B 11/643; F41B 11/89; F42B 6/003; F42B 6/02; F42B 6/10

USPC ..... 124/22, 23.1, 24.1, 65, 66, 67

See application file for complete search history.

(56) References Cited

U.S. PATENT DOCUMENTS

| | | | | |
|---|---|---|---|---|
| 115,638 A | | 6/1871 | Quackenbush | |
| 224,254 A | * | 2/1880 | Warne | F41J 9/16 124/16 |
| 2,069,821 A | * | 2/1937 | Douglas | F41B 11/00 124/67 |
| 2,214,224 A | * | 9/1940 | Douglas | F41B 11/52 124/67 |
| D166,831 S | | 5/1952 | Stevens | |
| D186,080 S | | 9/1959 | Philp | |

(Continued)

OTHER PUBLICATIONS

International Searching Authority, International Search Report and The Written Opinion of The International Searching Authority, dated Nov. 17, 2021, Ten pages.

*Primary Examiner* — Alexander R Niconovich

(74) *Attorney, Agent, or Firm* — Goldstein Law Offices, P.C.

(57) ABSTRACT

An assembly for launching toy projectiles includes a body having a bore, a plunger extendable from the bore, and a shaft removably attachable to the body. The body includes a first recess having a first diameter for receiving a first projectile. The shaft includes a second diameter for receiving a second projectile therearound and a second recess having a third diameter for receiving a third projectile therein. The first diameter is substantially equal to a diameter of the first projectile, the second diameter is substantially equal to a diameter of the second projectile, and the third diameter is substantially equal to a diameter of the third projectile but smaller than the second diameter. The plunger drives air through the assembly when released from an extended position to eject any one of the first, second, or third projectiles positioned in the first recess, on the shaft, or in the second recess.

20 Claims, 19 Drawing Sheets

(56) References Cited

U.S. PATENT DOCUMENTS

D224,254 S 7/1972 Hill
4,086,901 A * 5/1978 Clement ..... F41B 5/0073 473/569
4,261,321 A * 4/1981 Nishioka ..... F41B 5/10 124/67
4,625,706 A 12/1986 Turner, Jr.
4,742,812 A * 5/1988 Goodman ..... F41B 5/12 124/25
5,224,464 A * 7/1993 Burnham ..... F41B 11/642 124/16
5,242,323 A * 9/1993 Rappaport ..... F41B 11/642 124/66
5,267,549 A * 12/1993 Webber ..... F41B 11/641 124/59
5,522,374 A * 6/1996 Clayton ..... F41B 11/646 124/66
5,678,528 A * 10/1997 Hadley ..... F41B 5/12 124/25.5
5,680,853 A * 10/1997 Clayton ..... F41B 11/55 124/66
5,711,284 A * 1/1998 Keenan, Jr. ..... F41B 5/14 124/67
5,711,289 A 1/1998 Keenan, Jr.
5,830,029 A * 11/1998 Siegel ..... F41B 5/0005 446/45
6,076,513 A * 6/2000 Doherty ..... F41B 11/642 124/66
6,997,770 B2 2/2006 Lapointe
7,444,775 B1 11/2008 Schuetz
7,677,232 B2 3/2010 Rosenblum et al.
7,918,219 B2 * 4/2011 Belokin ..... F41B 7/02 42/78
8,087,405 B2 * 1/2012 Mitchell ..... F41B 11/646 124/66
8,485,171 B2 * 7/2013 Romney ..... F41B 11/54 124/65
8,505,524 B2 * 8/2013 Lyon ..... F41B 5/14 473/409
8,893,696 B2 11/2014 Kenworthy
8,905,013 B2 12/2014 Romney
8,991,374 B1 * 3/2015 Conkel ..... F41B 7/006 124/44.5
9,080,830 B2 7/2015 Hendricks et al.
9,261,322 B1 2/2016 Conkel
9,297,608 B1 3/2016 Ma et al.
9,341,422 B2 * 5/2016 Rodich ..... F41B 11/643
9,513,075 B2 * 12/2016 Lallier ..... F41A 9/73
9,522,340 B1 * 12/2016 Binkley ..... F41B 7/08
10,928,154 B1 * 2/2021 Kam ..... F41B 11/646
2009/0050128 A1 2/2009 Mitchell
2013/0205633 A1 8/2013 Pierce et al.
2014/0114281 A1 3/2014 Weyer
2016/0091274 A1 3/2016 Ma et al.

* cited by examiner

THREE-IN-ONE TOY PROJECTILE LAUNCHING ASSEMBLY

CROSS REFERENCE TO RELATED APPLICATIONS

The present application is a Continuation of U.S. patent application Ser. No. 17/111,460, filed Dec. 3, 2020, which is relied upon and incorporated herein by reference in its entirety. The entire disclosure of any publication or patent document mentioned herein is entirely incorporated by reference.

TECHNICAL FIELD

The present disclosure relates generally to toy projectile launching systems. More particularly, the present disclosure relates to a pneumatic toy bow assembly capable of launching at least three different types of toy projectiles.

BACKGROUND

Toy projectile launching apparatus, such as toy guns, sling shots, bow and arrows, and darts guns are each individually capable of launching multiple projectiles, but are limited to adequately launching only one kind of projectile. Indeed, their structures are designed and suited particularly for launching only one kind of projectile. This limits the types of games that can be played with one toy projectile launcher and the overall diversity of the launcher. For example, existing toy projectile launchers will include either an elastic string limiting the toy projectile launcher to an arrow-shaped or arrow-like projectile, a barrel sized and configured specifically to receive and eject either a ball projectile or a dart, or a magazine and/or drum sized and configured to receive either a ball or dart/bullet shaped projectile therein. Moreover, these toy projectile launchers include no means for altering their structure to enable interchanging of the types of projectiles launched therewith. Presumably, one could attempt to launch different types of projectiles with any one of the launchers, however, each launcher is not particularly suited for every kind of projectile and as such would not function well and defeat the object of effectively launching a projectile and having fun.

Accordingly, there is a need in the art for a toy projectile launching assembly capable of launching at least three different kinds of projectiles.

While these units may be suitable for the particular purpose employed, or for general use, they would not be as suitable for the purpose of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a toy projectile launching assembly capable of launching at least three different kinds of toy projectiles. Accordingly, the present disclosure provides a pneumatic toy projectile launching assembly including a bow structure having a body including a front end, a rear end, a longitudinal bore extending along the body from the front end to the rear end, a spring-biased plunger slidably disposed within the longitudinal bore, the spring-biased plunger extendable out of the longitudinal bore to form an elastic potential energy toward the front end of the body, and a cavity including a first recess disposed at the front end having a first diameter that is configured to receive and sustain a first projectile having a diameter that is substantially the same as the first diameter, such as a spherical projectile, the first recess in fluid communication with the longitudinal bore. The pneumatic toy projectile launching assembly also includes an elongate projectile shaft that is removably attachable to the front end of the body. The elongate projectile shaft includes a second diameter for receiving elongate projectiles including a cylindrical bore having a diameter that is substantially the same as the diameter of the projectile shaft, and a second recess including a third diameter that is configured to receive and sustain a third projectile having a diameter that is substantially the same as the third diameter. The elongate projectile shaft includes a longitudinal air tunnel in fluid communication with the first recess and the second recess. The spring-biased plunger, when released from an extended position, slides toward the front end of the body utilizing the energy created by the spring to compress air within the longitudinal bore toward the front end. The spring-biased plunger drives the compressed air to the first recess and through the longitudinal air tunnel to the second recess to eject a projectile positioned on the elongate projectile shaft or in either of the first recess or the second recess.

An aspect of an example embodiment in the present disclosure is to provide a toy projectile launching assembly including three different kinds of toy projectiles suitable for launching by the toy projectile launching assembly. Accordingly, the present disclosure provides a first spherical projectile, a second elongate projectile, and a third elongate projectile. The first spherical projectile includes a fourth diameter substantially equal to the first diameter of the first recess such that the first spherical projectile is configured to friction fit within the first recess. The second elongate projectile includes a body having third length and a cylindrical bore including a fifth diameter that is substantially equal to the second diameter such that the cylindrical bore is configured to friction fit over the elongate projectile shaft. The third elongate projectile includes a fourth length and a sixth diameter, in which the fourth length is smaller than the third length and the sixth diameter is substantially equal to the third diameter of the second recess such that the second elongate projectile is configured to friction fit within the third recess.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
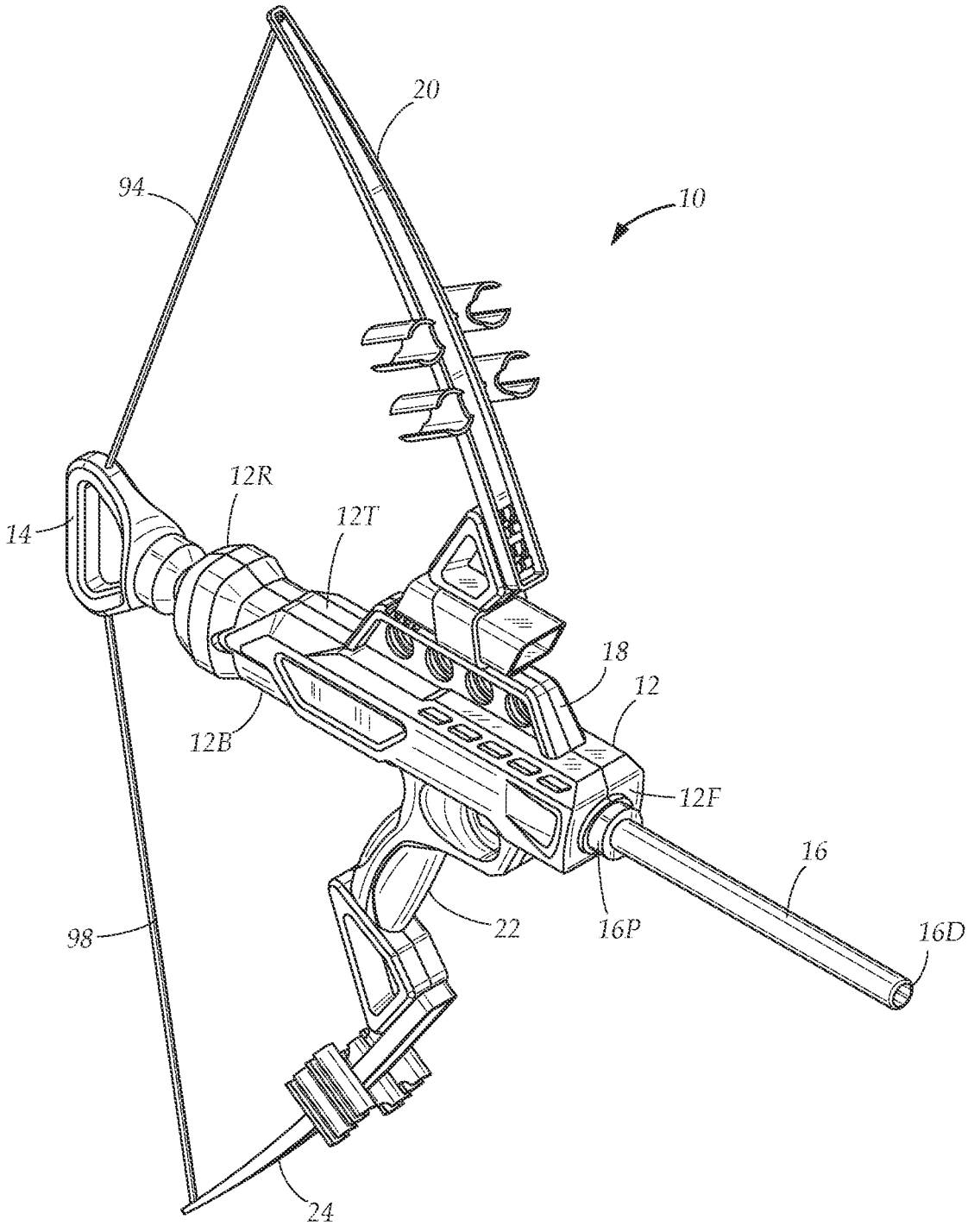
FIG. 1 is a perspective view of the three-in-one toy projectile launching assembly, illustrating the assembly with the projectile shaft attached thereto according to one embodiment of the present disclosure.
Figure 2A:
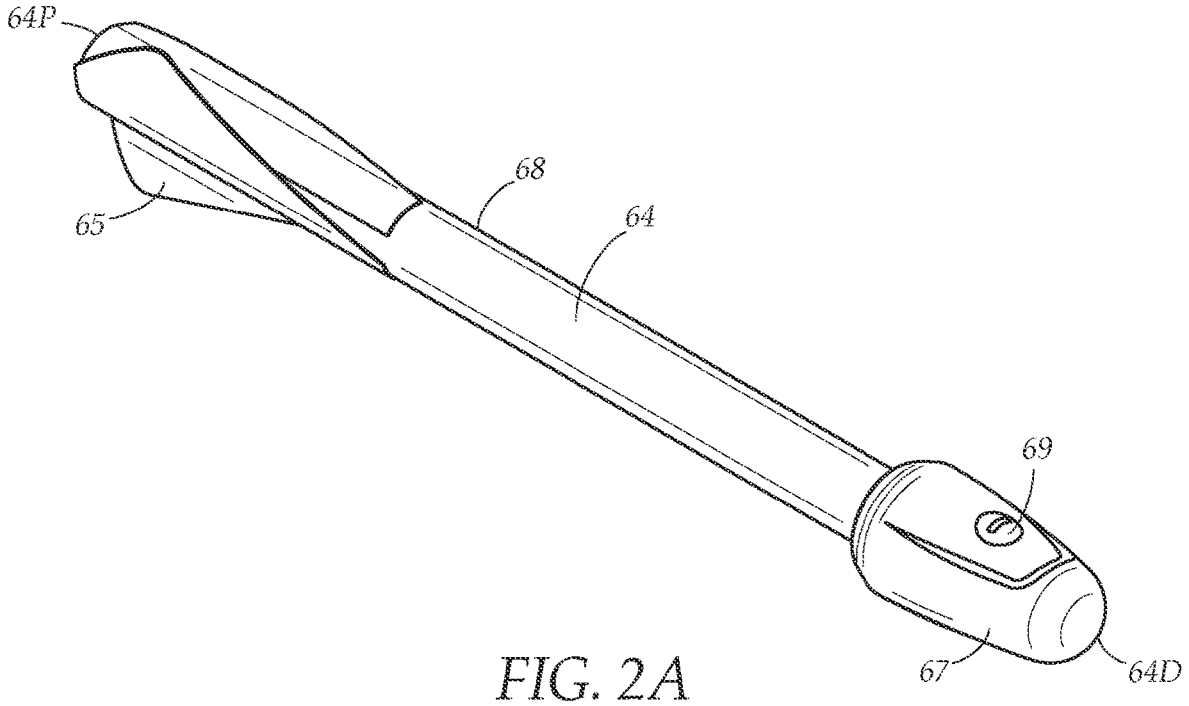
FIG. 2A is a front perspective view of the second elongate projectile of the three-in-one toy projectile launching assembly according to one embodiment of the present disclosure.
Figure 2B:
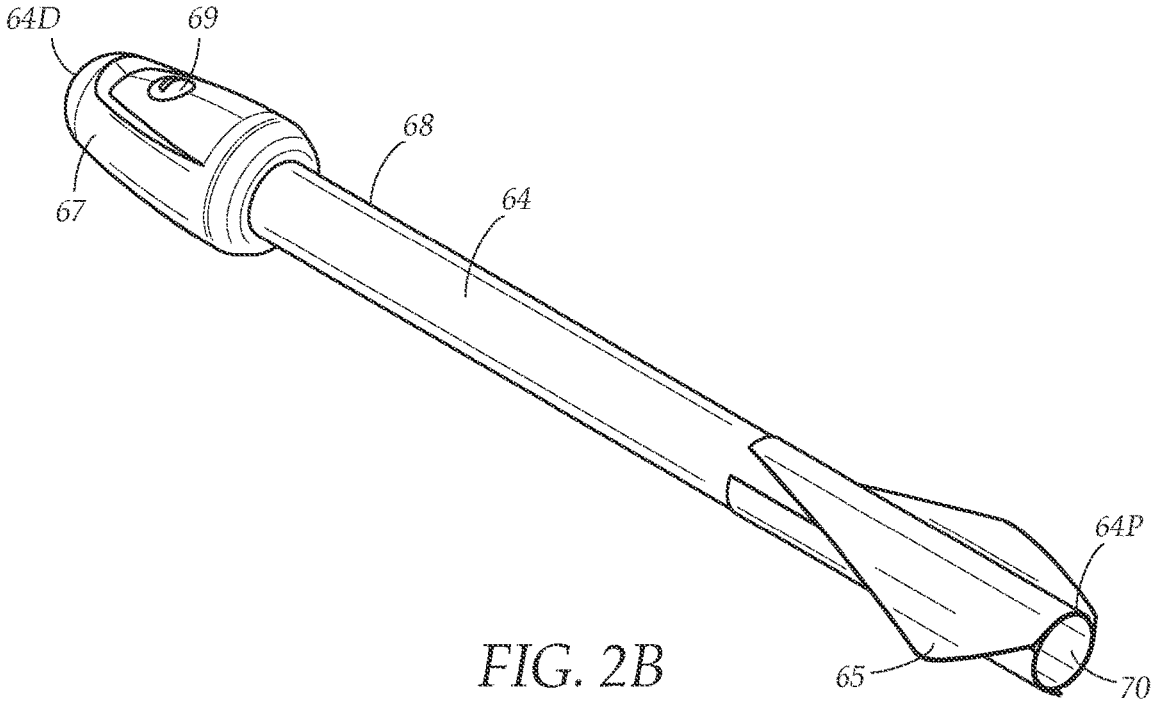
FIG. 2B is a rear perspective view of the second elongate projectile of FIG. 2A, illustrating the hollow interior of the second elongate projectile according to one embodiment of the present disclosure.
Figure 3A:
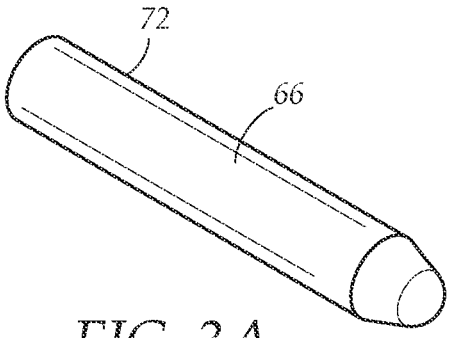
FIG. 3A is a front perspective view of the third elongate projectile of the three-in-one toy projectile launching assembly according to one embodiment of the present disclosure.
Figure 3B:
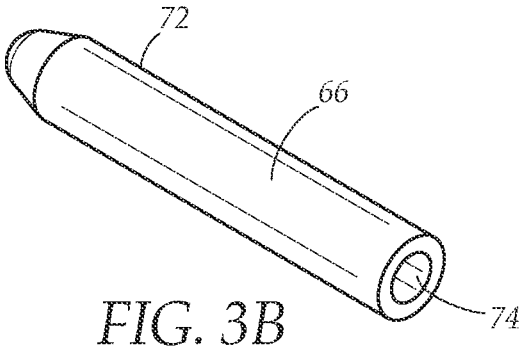
FIG. 3B is a rear perspective view of the third elongate projectile of FIG. 3A, illustrating the cylindrical bore of the third elongate projectile according to one embodiment of the present disclosure.
Figure 4:
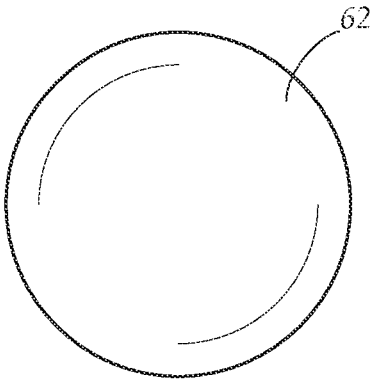
FIG. 4 is a perspective view of the first spherical projectile of the three-in-one toy projectile launching assembly according to one embodiment of the present disclosure.
Figure 5:
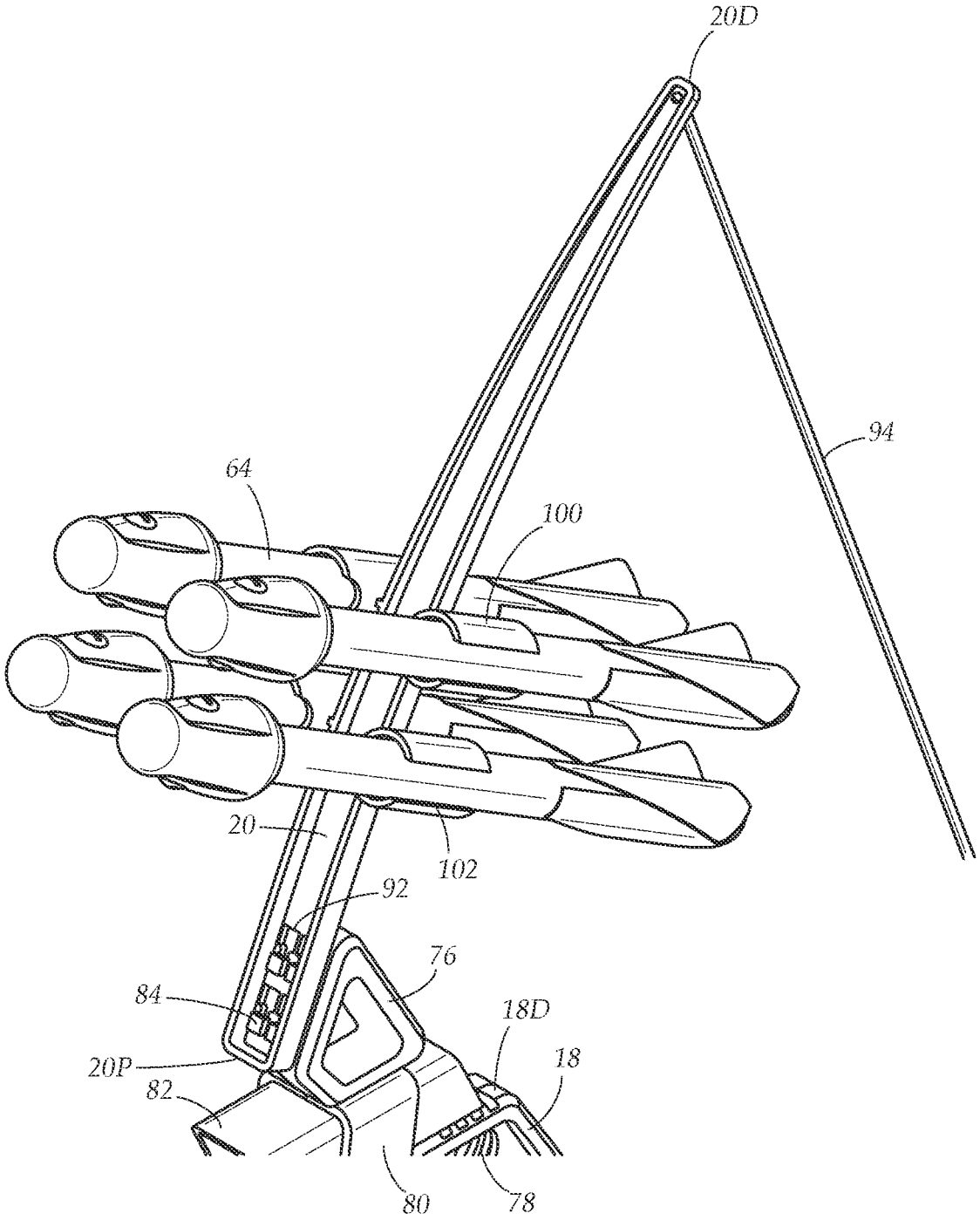
FIG. 5 is perspective view of the first projectile holder of the three-in-one toy projectile launching assembly, illustrating one manner in which the first projectile holder is capable of retaining the second elongate projectiles thereon according to one embodiment of the present disclosure.
Figure 6:
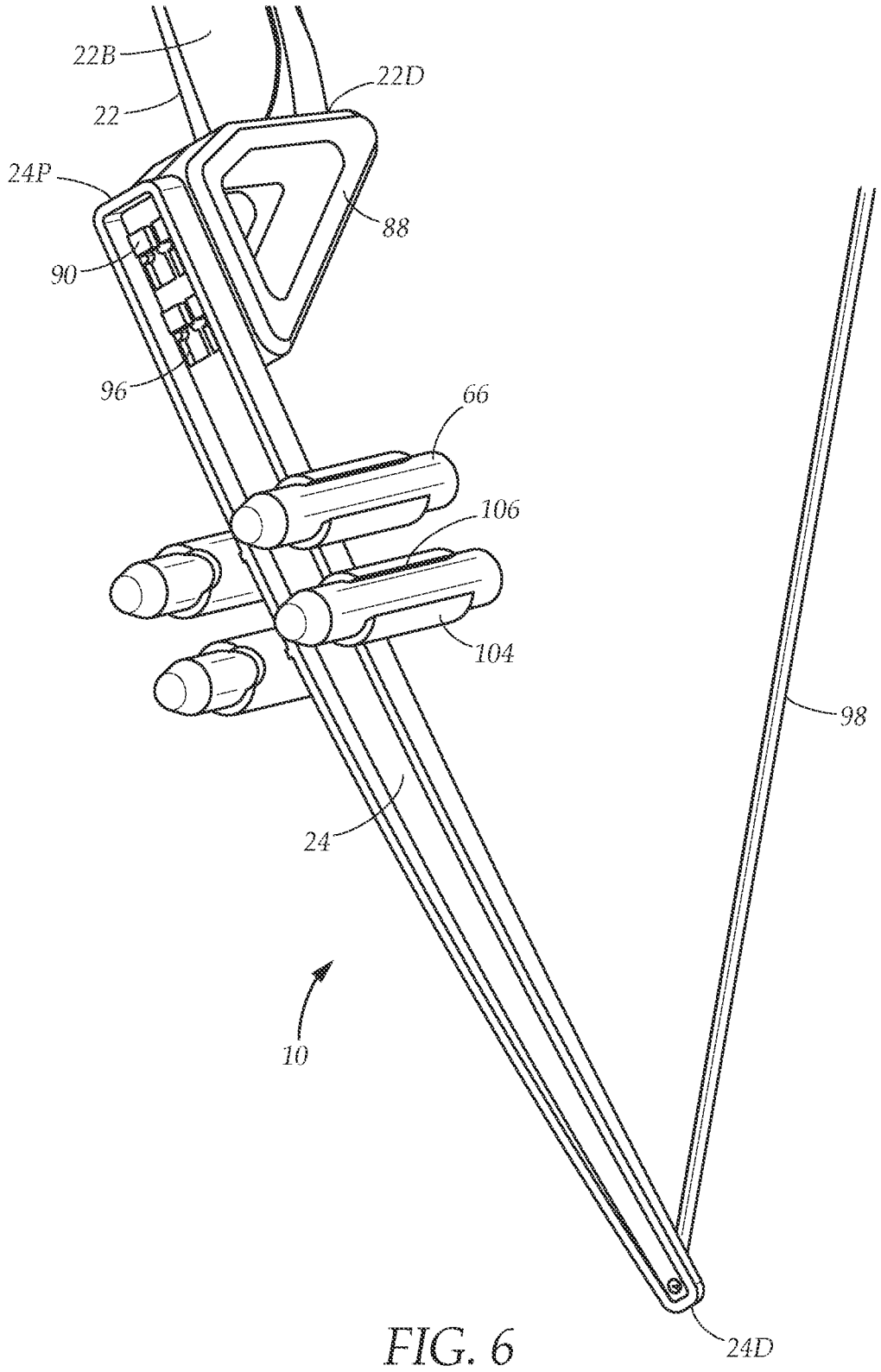
FIG. 6 is perspective view of the second projectile holder of the three-in-one toy projectile launching assembly, illustrating one manner in which the second projectile holder is capable of retaining the third elongate projectiles thereon according to one embodiment of the present disclosure.
Figure 7:
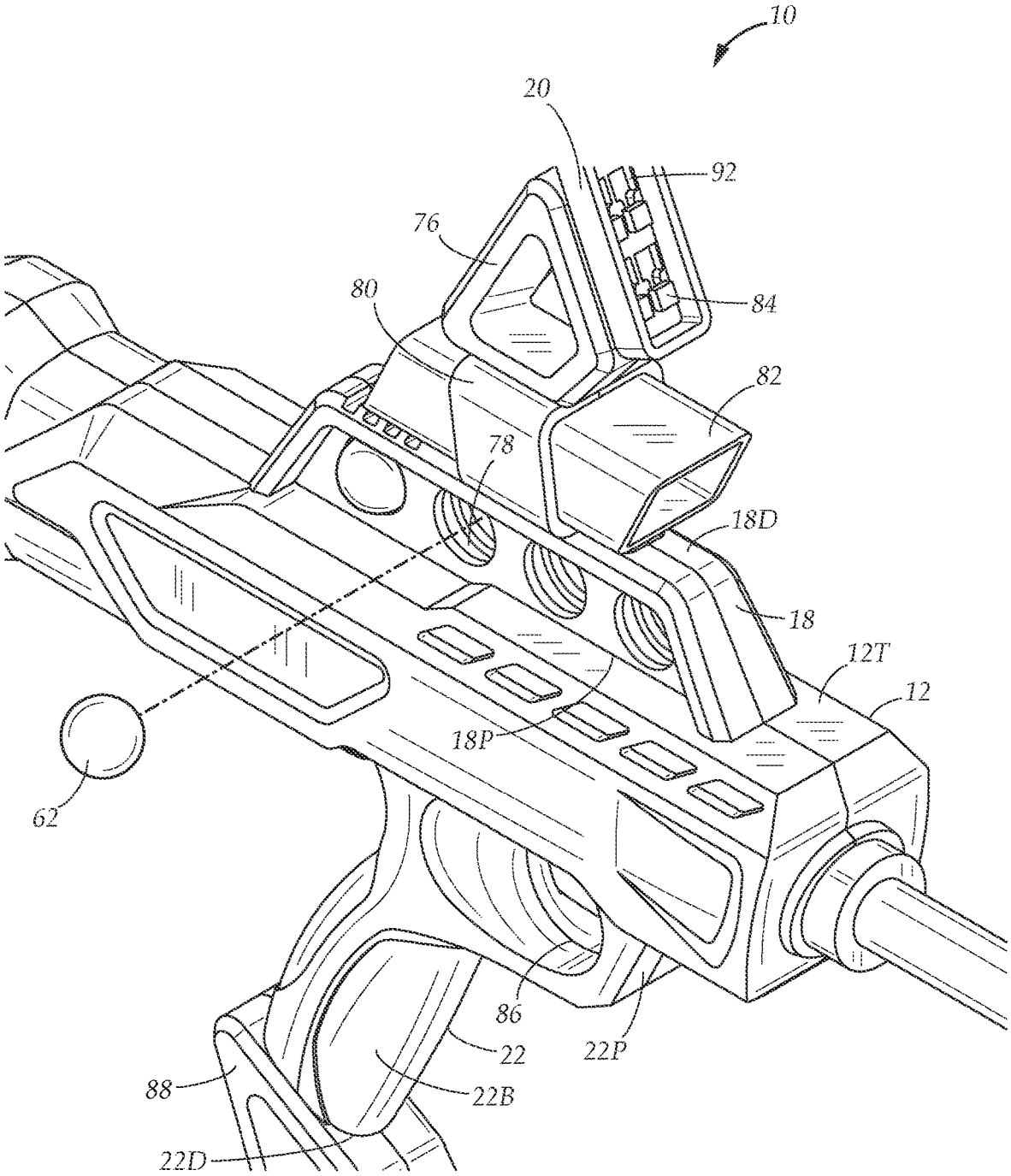
FIG. 7 is perspective view of the third projectile holder of the three-in-one toy projectile launching assembly, illustrating how the third projectile holder is capable of receiving and retaining the first spherical projectiles thereon according to one embodiment of the present disclosure.
Figure 8:
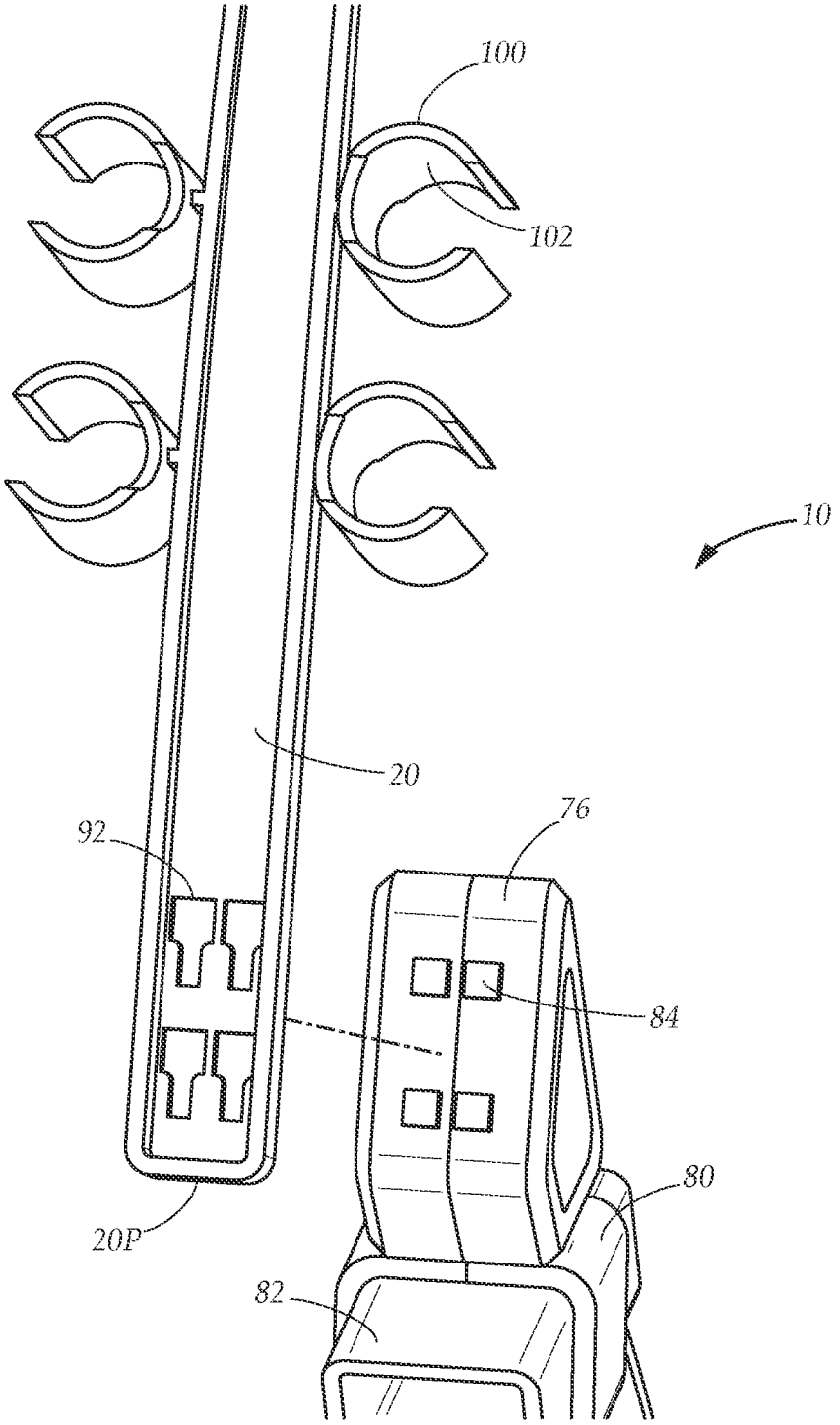
FIG. 8 is a close-up view of the proximal end of the upper arm and the first bracket of the three-in-one toy projectile launching assembly, illustrating one manner in which the upper arm is capable of removably attaching to the first bracket according to one embodiment of the present disclosure.
Figure 9A:
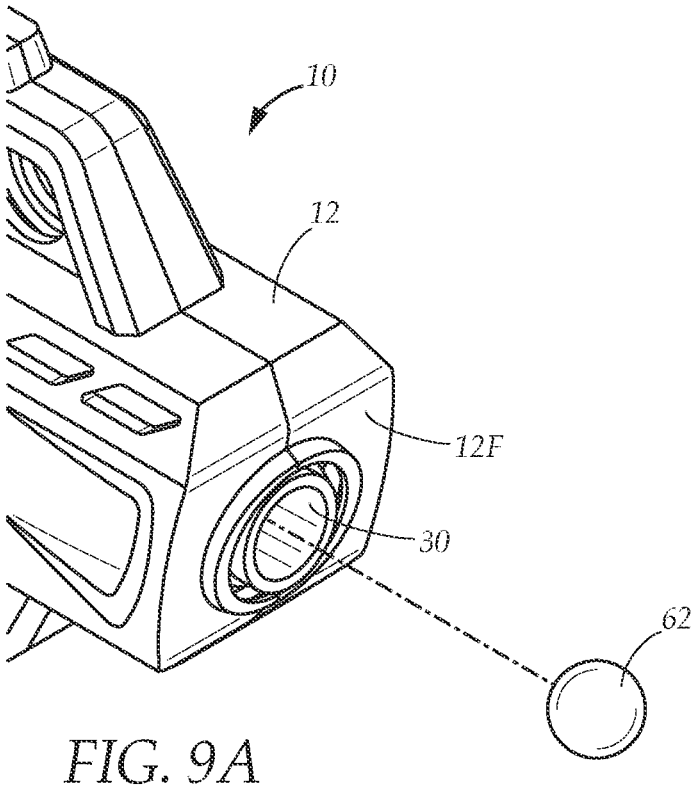
FIG. 9A is a close-up view of the front end of the body of the three-in-one toy projectile launching assembly, illustrating one manner in which the first recess receives the first spherical projectile therein according to one embodiment of the present disclosure.
Figure 9B:
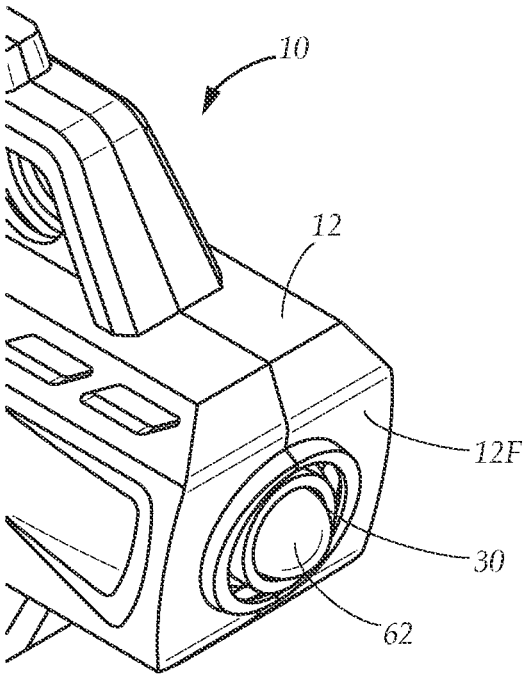
FIG. 9B is a close-up view of the front end of the body of the three-in-one toy projectile launching assembly, illustrating the first spherical projectile inserted into the first recess according to one embodiment of the present disclosure.
Figure 10A:
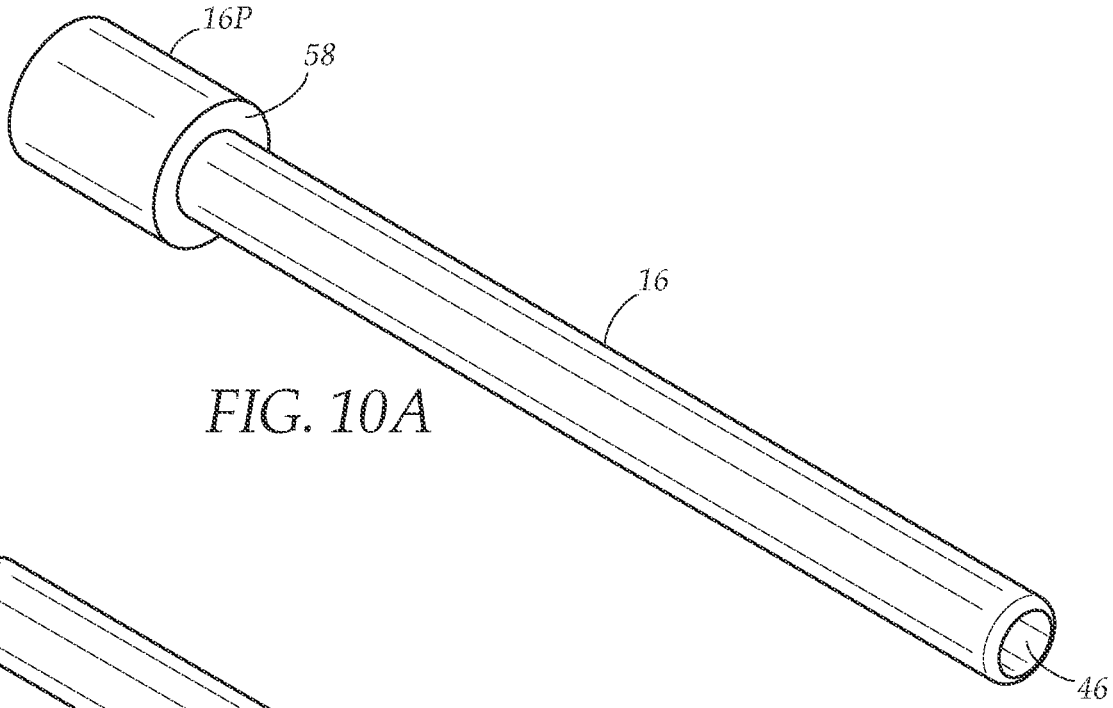
FIG. 10A is a left-side perspective view of the elongate projectile shaft of the three-in-one toy projectile launching assembly, illustrating the second recess of thereof according to one embodiment of the present disclosure.
Figure 10B:
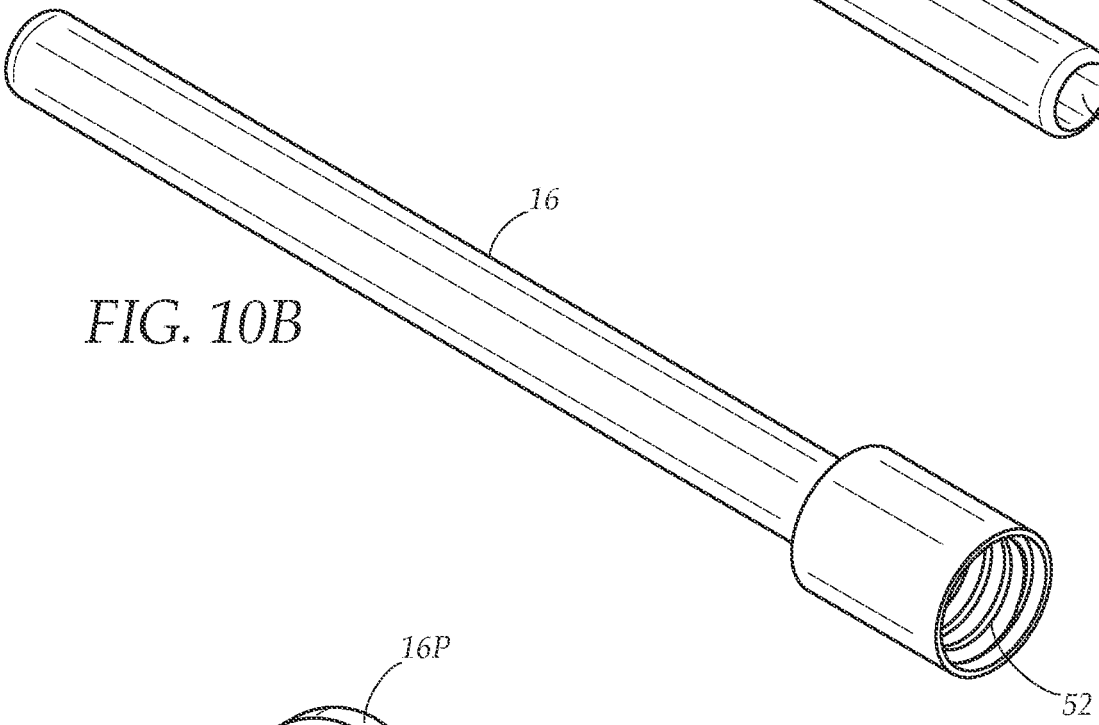
FIG. 10B is a right-side perspective view of the elongate projectile shaft of FIG. 10A, illustrating the threaded recess thereof according to one embodiment of the present disclosure.
Figure 10C:
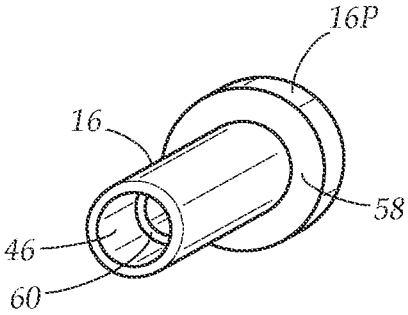
FIG. 10C is a front perspective view of the elongate projectile shaft of FIG. 10A, illustrating the second recess and the air tunnel thereof according to one embodiment of the present disclosure.
Figure 11:
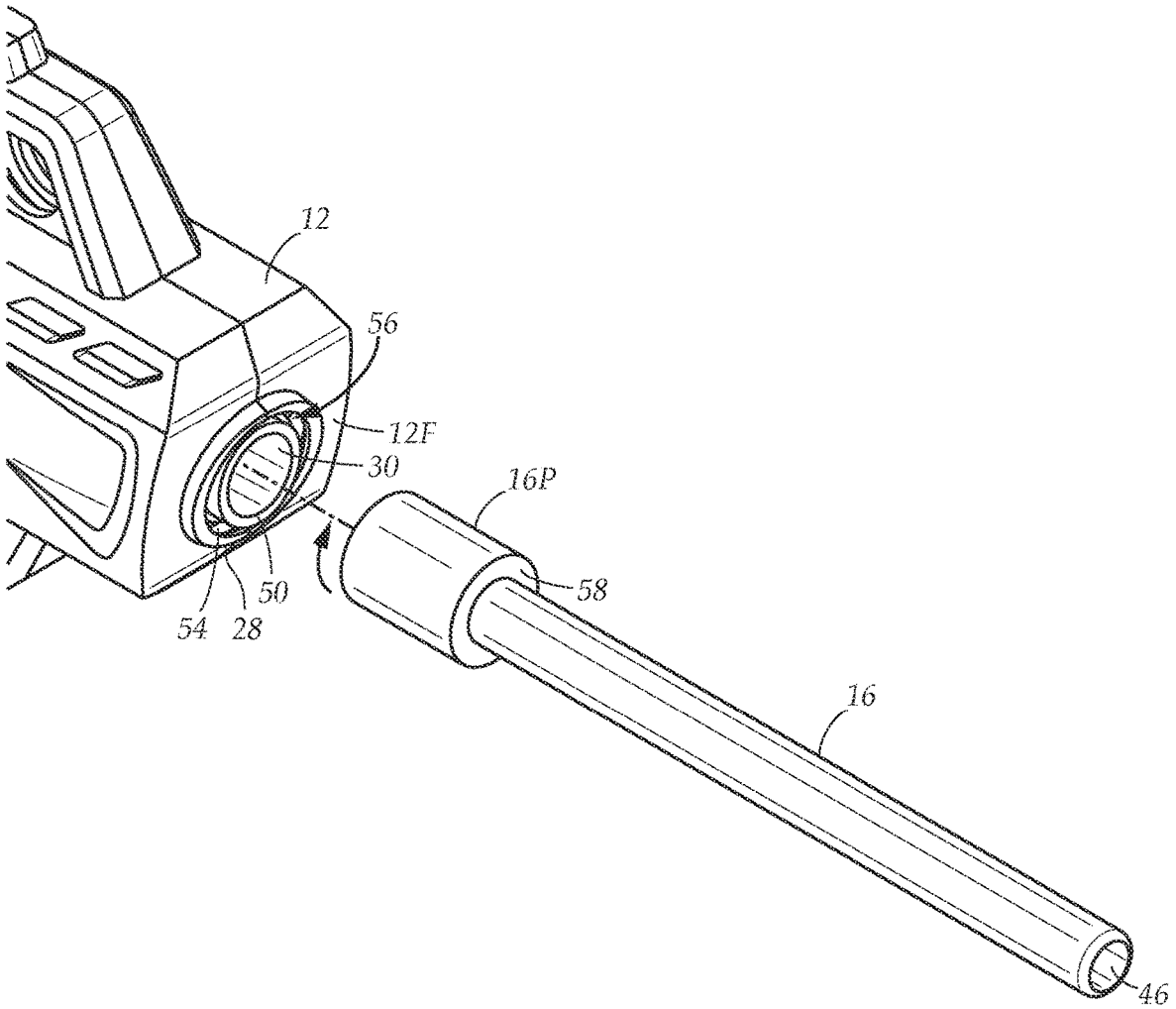
FIG. 11 is a close-up view of the front end of the body of the three-in-one toy projectile launching assembly, illustrating one manner in which the elongate projectile shaft engages with the first recess according to one embodiment of the present disclosure.
Figure 12A:
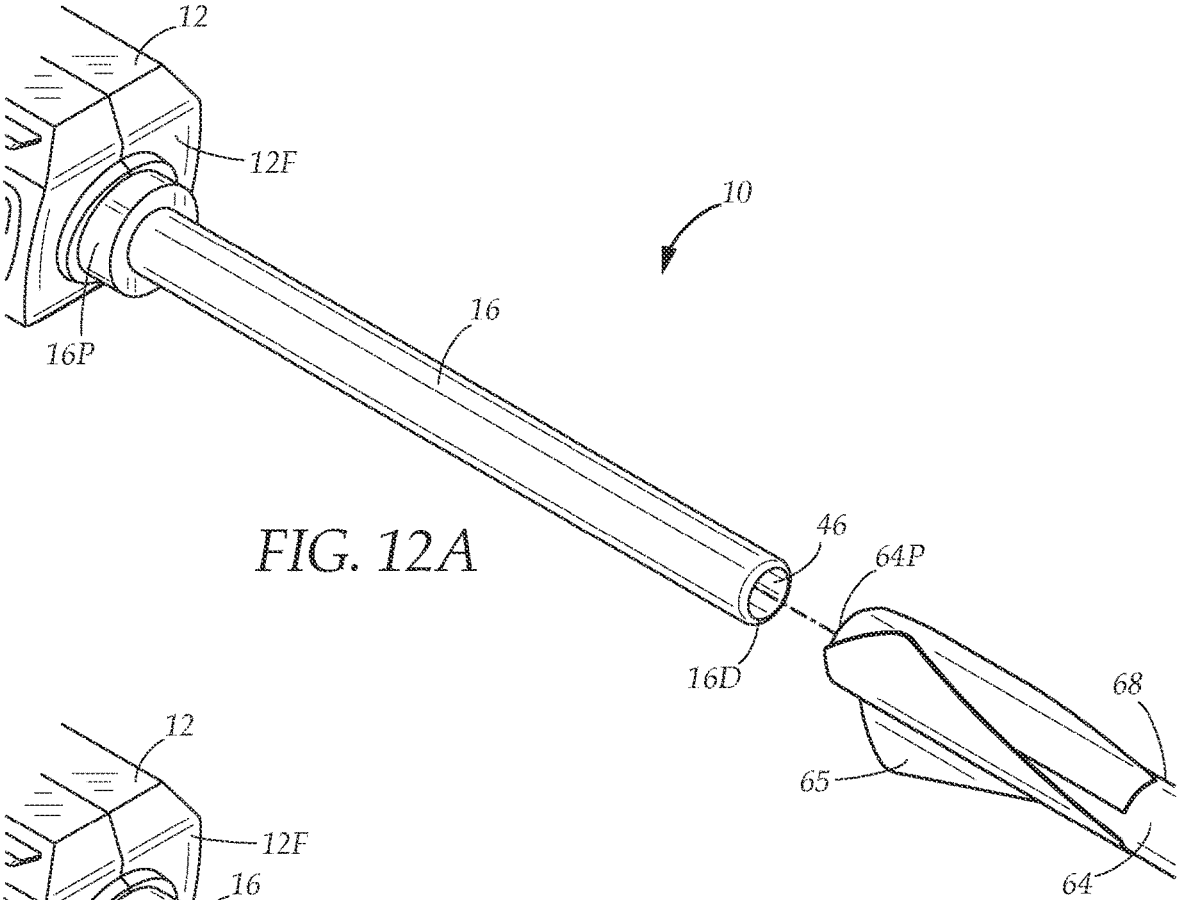
FIG. 12A is a close-up view of the front end of the body with the elongate projectile shaft attached thereto, illustrating one manner in which the projectile shaft receives the second elongate projectile thereon according to one embodiment of the present disclosure.
Figure 12B:
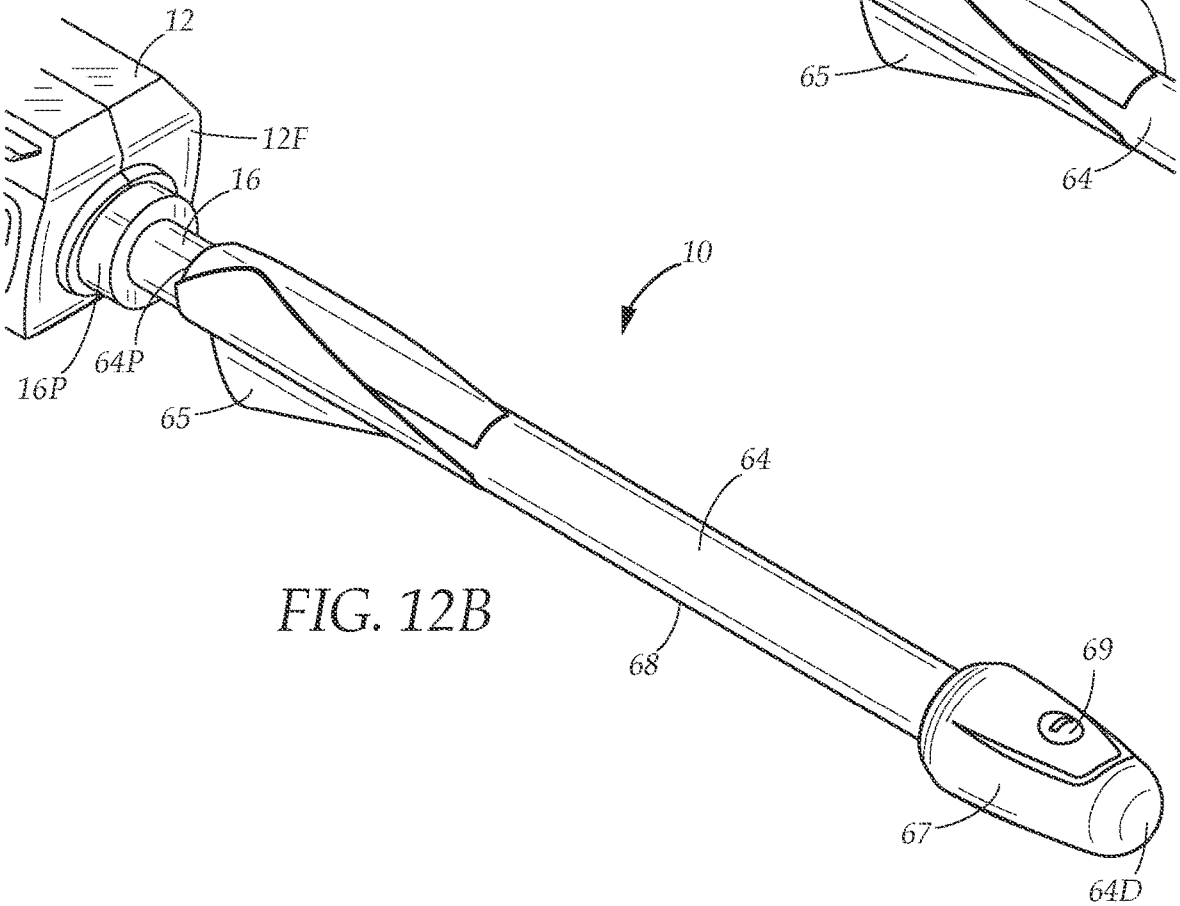
FIG. 12B is a close-up view of the front end of the body with the elongate projectile shaft attached thereto, illustrating the second elongate projectile mounted onto the projectile shaft according to one embodiment of the present disclosure.
Figure 13A:
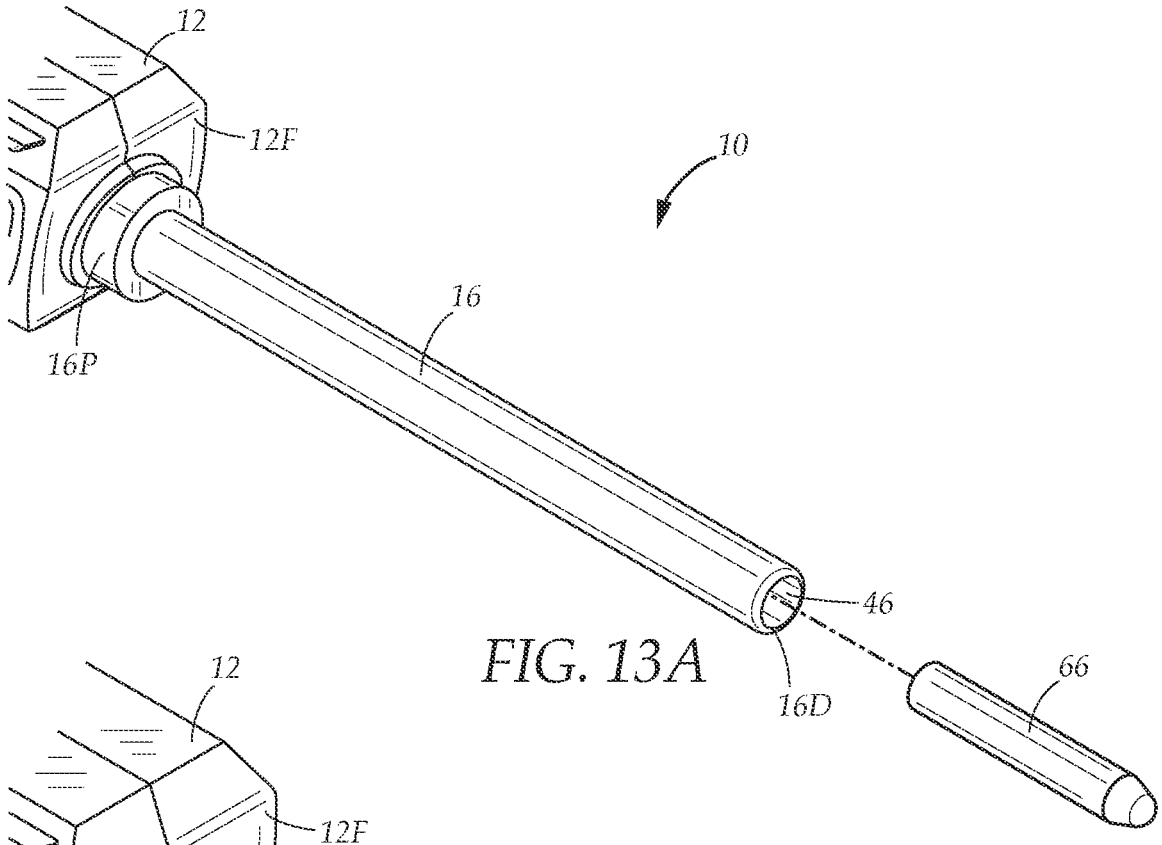
FIG. 13A is a close-up view of the front end of the body with the elongate projectile shaft attached thereto, illustrating one manner in which the second recess of the projectile shaft receives the third elongate projectile therein according to one embodiment of the present disclosure.
Figure 13B:
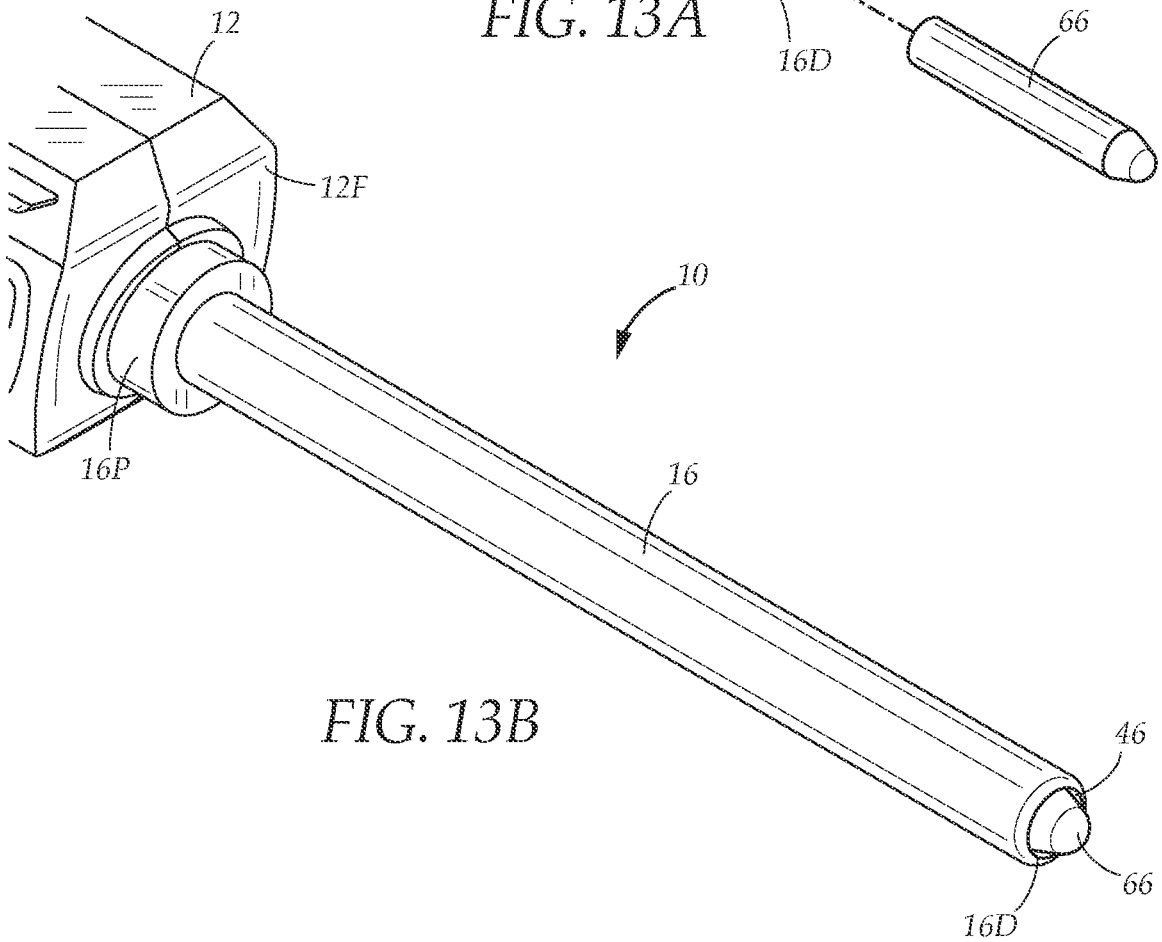
FIG. 13B is a close-up view of the front end of the body with the elongate projectile shaft attached thereto, illustrating the third elongate projectile inserted into the first recess of the projectile shaft according to one embodiment of the present disclosure.

FIG. 1 illustrates a toy projectile launching assembly 10 capable of launching at least three different types of projectiles. In embodiments, the toy projectile launching assembly 10 comprises a bow structure including a body 12 having a top end 12T, a bottom end 12B opposite the top end 12T, a front end 12F, a rear end 12R opposite the front end 12F, a spring-biased plunger 14 extendable out of the body 12 for launching projectiles using compressed air driven through the body 12 when released from an extended position, and an elongate projectile shaft 16 having a proximal end 16P removably attachable to the front end 12F, and a distal end 16D opposite the proximal end 16P. In some embodiments, the assembly 10 comprises a projectile holder 18 extending upwardly from the body 12, a bow-shaped upper arm 20 extending upwardly from a projectile holder 18, a grip handle 22 extending downwardly from the body 12, and a bow-shaped lower arm 24 extending downwardly from the grip handle 22.

Figure 14:
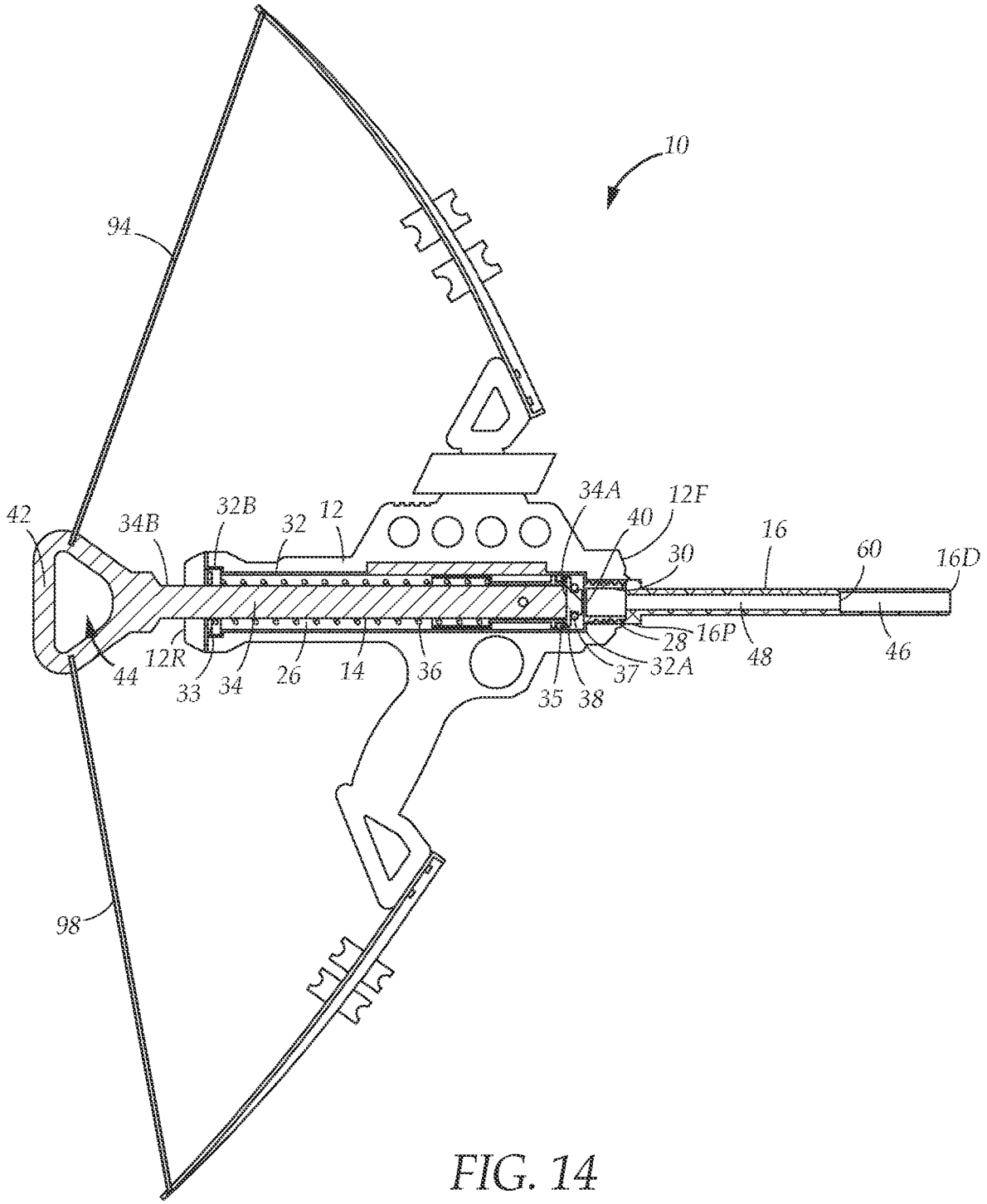
FIG. 14 is a cross-sectional view of the three-in-one toy projectile launching assembly with the projectile shaft attached to the front end of the body, illustrating the internal components of the assembly according to one embodiment of the present disclosure.
Figure 15:
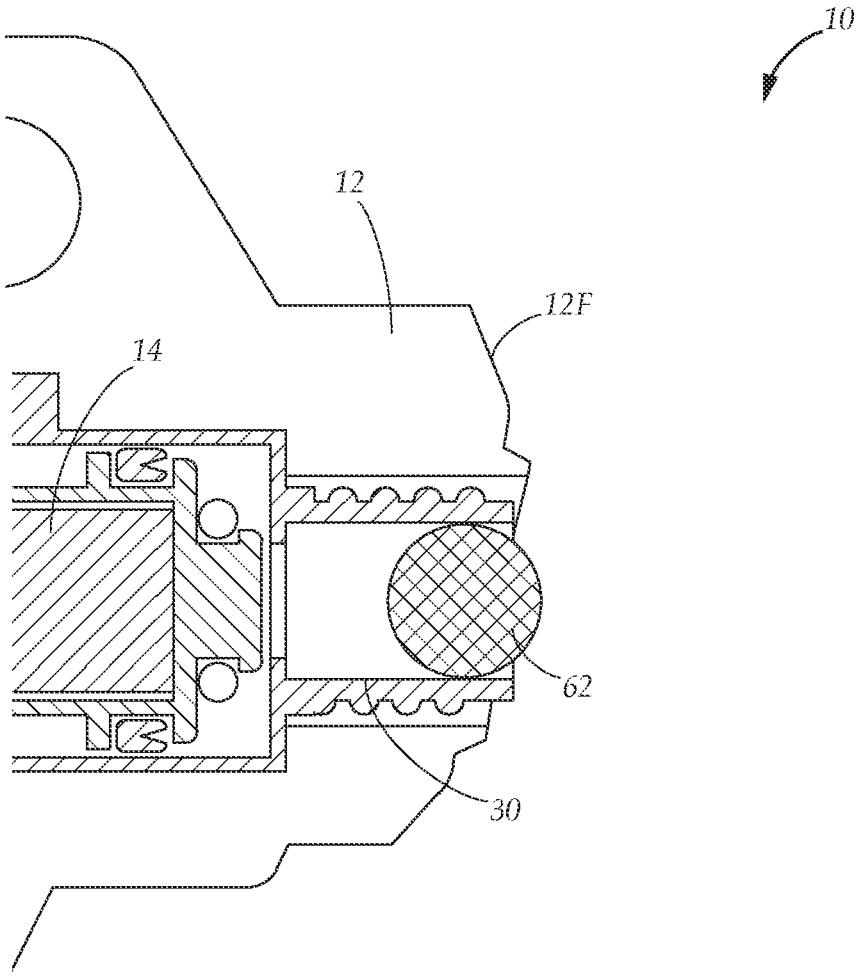
FIG. 15 is a close-up cross-sectional view of the front end of the body of the three-in-one toy projectile launching assembly, illustrating on manner in which the first recess receives a first spherical projectile according to one embodiment of the present disclosure.
Figure 16:
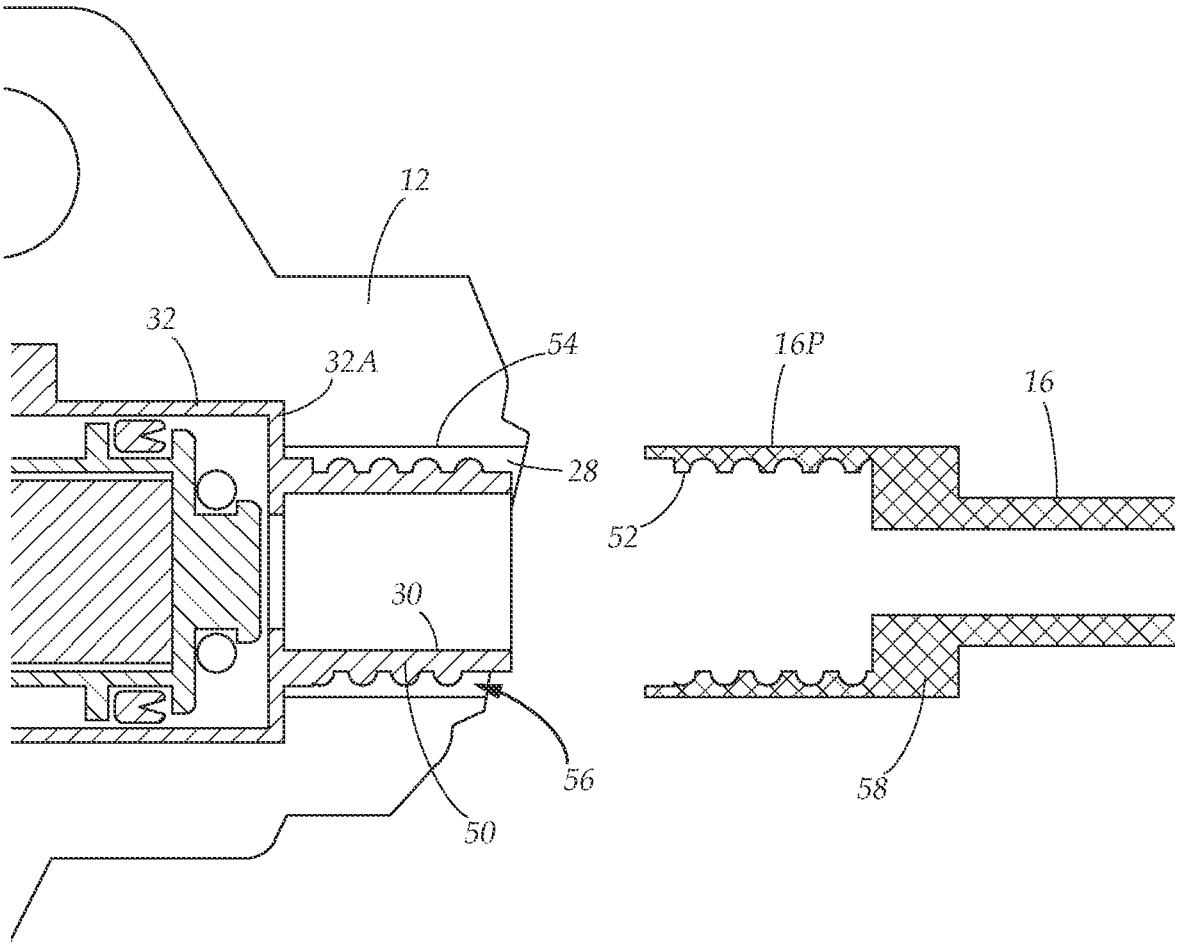
FIG. 16 is a close-up cross-sectional view of the front end of the body and the proximal end of the elongate projectile shaft, illustrating one manner in which the threaded recess of the projectile shaft engages the threaded member of the first recess according to one embodiment of the present disclosure.
Figure 17:
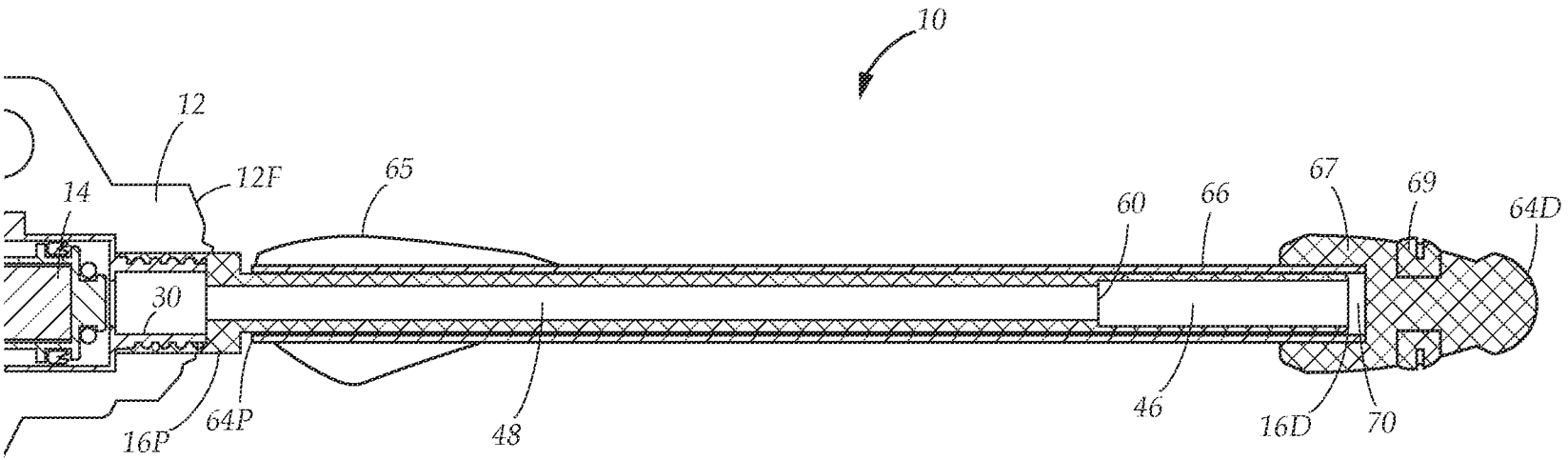
FIG. 17 is a close-up cross-sectional view of the front end of the body and the elongate projectile shaft with a second elongate projectile mounted thereon, illustrating one manner in which the second elongate projectile is mounted onto the projectile shaft according to one embodiment of the present disclosure.
Figure 18:
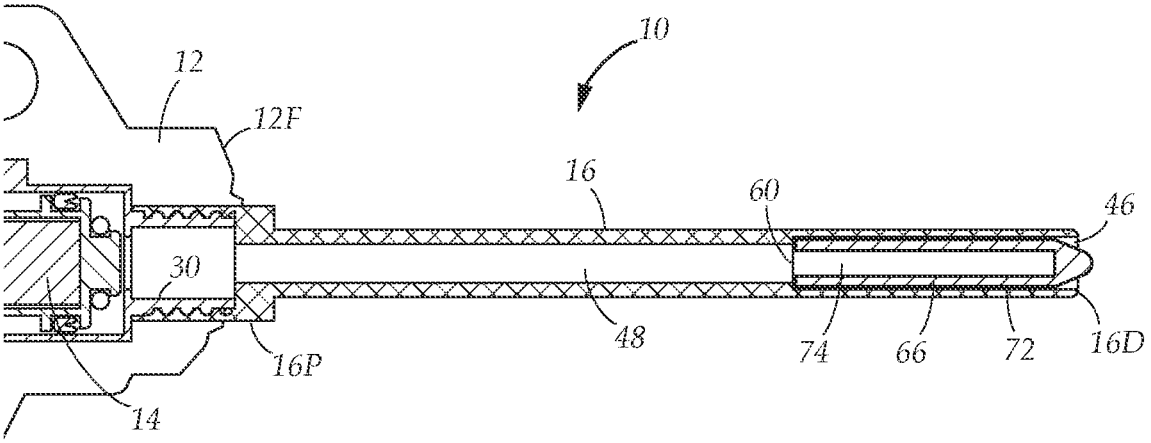
FIG. 18 is a close-up cross-sectional view of the front end of the body and the elongate projectile shaft with a third elongate projectile inserted therein, illustrating one manner in which an third elongate projectile is inserted into the second recess of the projectile shaft according to one embodiment of the present disclosure.
Figure 19:
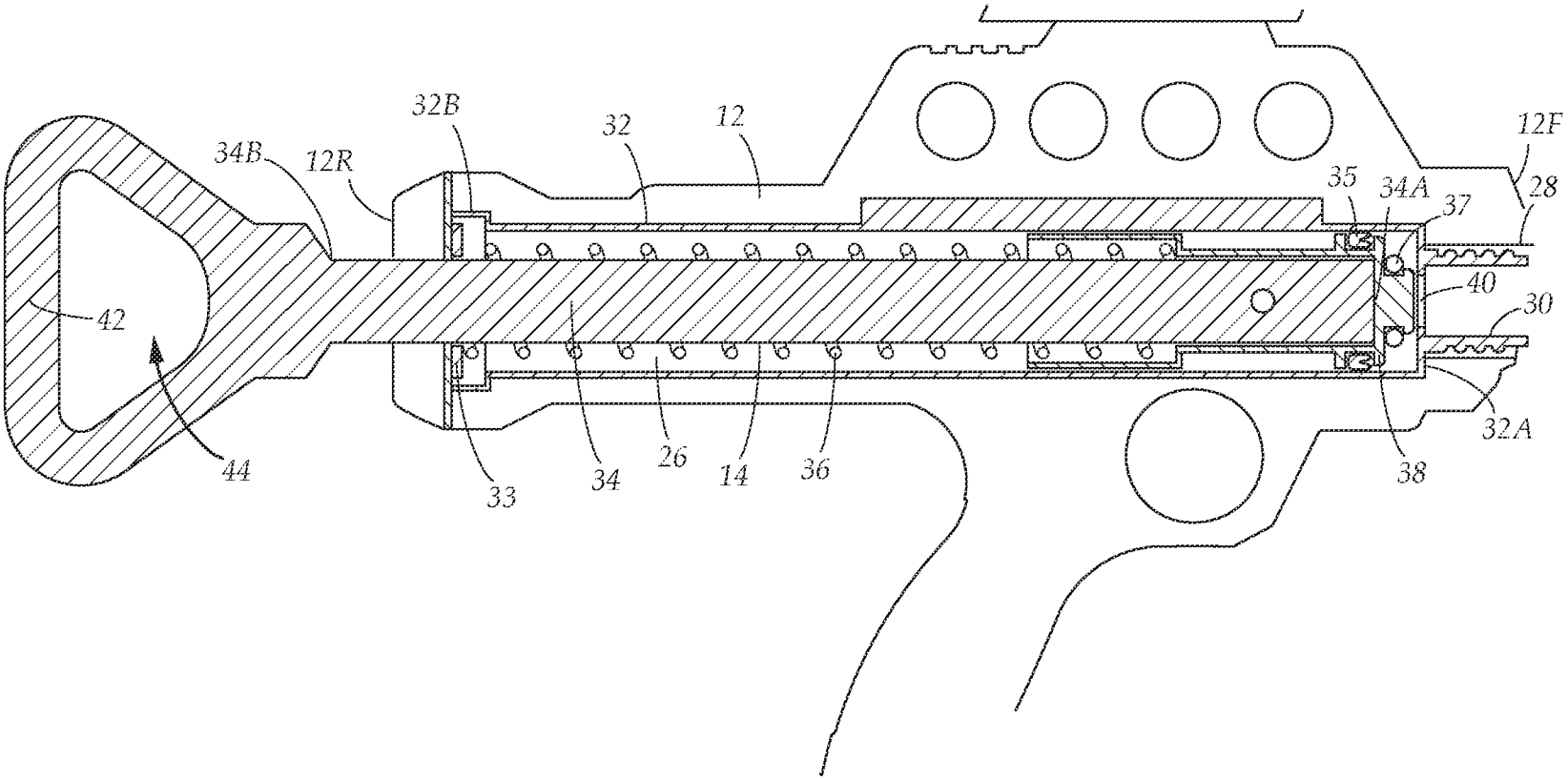
FIG. 19 is a close-up cross-sectional view of the body of the three-in-one toy projectile launching assembly, illustrating the components and internal arrangement of spring-biased plunger within the longitudinal bore of the body when the spring-biased plunger has not been extended out of the longitudinal bore according to one embodiment of the present disclosure.
Figure 20:
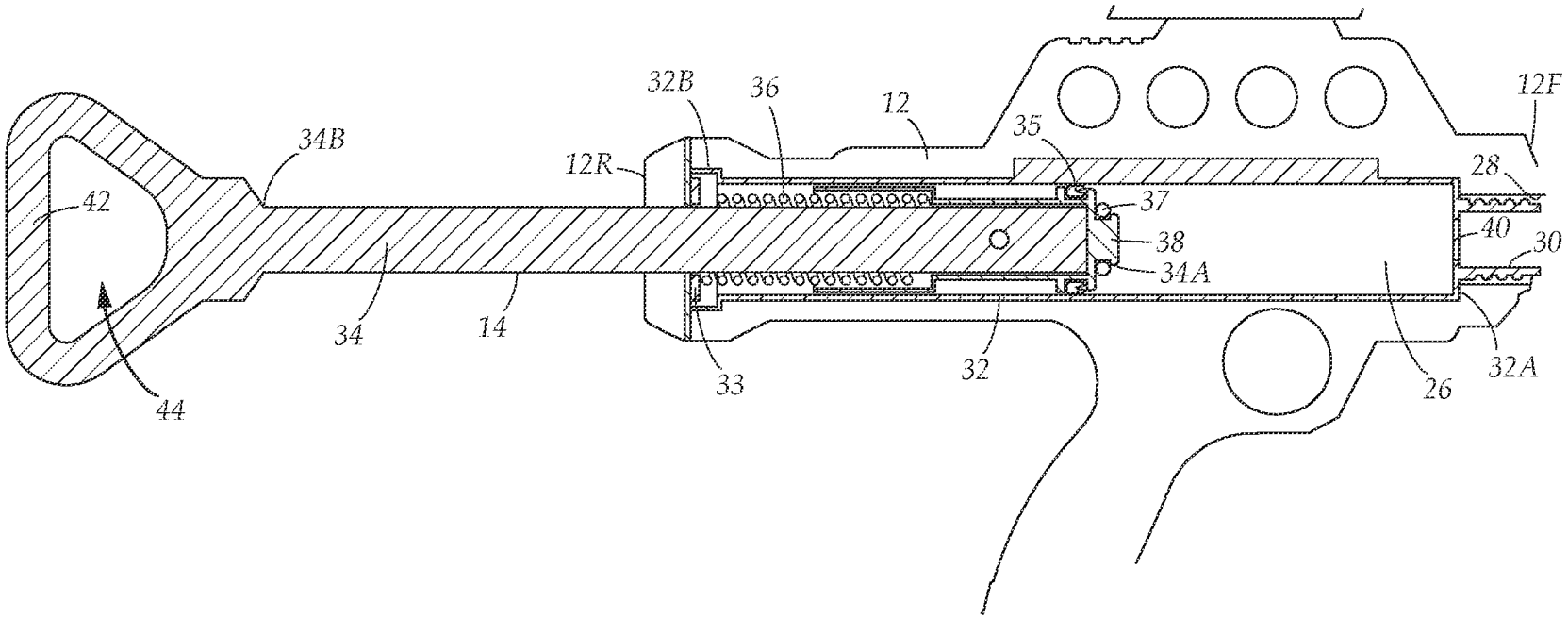
FIG. 20 is a close-up cross-sectional view of the body of the three-in-one toy projectile launching assembly, illustrating the components and internal arrangement of the spring-biased plunger within the longitudinal bore of the body when the spring-biased plunging rod has been extended out of the longitudinal bore according to one embodiment of the present disclosure.

Referring now to FIG. 14, FIG. 19, and FIG. 20, the body 12 comprises a longitudinal bore 26 extending along a longitudinal axis of the body 12 from the front end 12F to the rear end 12R and a cavity 28 disposed at the front end 12F that includes a first recess 30 having a first diameter. The spring-biased plunger 14 is extendable out of the longitudinal bore 26 to form elastic potential energy toward the front end 12F of the body 12. The first recess 30 is in fluid communication with the longitudinal bore 26.

The spring biased plunger 14 comprises a piston tube 32 affixed to a surface of the longitudinal bore 26, a plunging rod 34 slidably disposed within the piston tube 32, a spring 36 disposed around the plunging rod 34, and a piston 38 operably coupled to the spring 36. The piston tube 32 comprises a first end 32A adjacent to the front end 12F of the body 12, a second end 32B adjacent to the rear end 12R of the body 12, and a circumference. The first end 32A of the piston tube 32 includes the first recess 30 and an aperture 40 in fluid communication with the first recess 30. The second end 32B of the piston tube 32 includes a spring ring 33.

The plunging rod 34 is extendable out of the longitudinal bore 26 via the rear end 12R of the body 12. The plunging rod 34 includes a plunging end 34A disposed within the longitudinal bore 26 and an extending end 34B opposite the plunging end 34A that protrudes outwardly from the rear end 12R of the body 12. The plunging end 34A includes the piston 38. The piston 38 is affixed to the plunging end 34A such that the piston 38 moves in parallel with the plunging rod 34. The piston 38 is coextensive with the circumference of the piston tube 32 so as to compress and drive substantially all of the air from within the longitudinal bore 26 toward the aperture 40 and first recess 30. In embodiments, the piston 38 includes a piston tube gasket 35, such as an O-ring, for frictionally sealing the piston 38 against the piston tube 32, and an aperture gasket 37, such as an O-ring, for sealing the aperture 40 when the plunging rod 32 is compressed against the first end 32A of the piston tube 32. The extending end 34B includes a draw handle 42 providing an opening 44 for a user to grasp to extend the plunging rod 34 out of the longitudinal bore 26 of the body 12. The spring 36 is biased toward the front end 12F of the body 12 such that as the plunging rod 34 is extended out of the longitudinal bore 26, the piston 38 deforms the spring 36 toward the rear end 12R of the body 12 forming and elastic potential that increases the further the plunging rod 34 is extended out of the longitudinal bore 26.

The elongate projectile shaft 16 comprises a second diameter, a first length, a second recess 46 at the distal end 16D, and a longitudinal air tunnel 48 extending along a longitudinal axis of the projectile shaft 16 from the proximal end 16P to the distal end 16D. The second recess 46 includes a third diameter and a second length. The second diameter and the first length of the overall projectile shaft 16 are larger than the third diameter and the second length of the second recess 46. The second recess 46 extends inwardly with respect to the distal end 16D along the longitudinal axis of the projectile shaft 16. The longitudinal air tunnel 48 is in fluid communication with the first recess 30, the aperture 40, and the second recess 46 when attached to the front end 12F of the body 12. The third diameter of the second recess 46 is larger than a diameter of the longitudinal air tunnel 48.

When the spring biased plunger 14 is released from an extended position, the elastic potential energy is converted to kinetic energy on the plunging rod 32, which drives the piston 36 toward the front end 12F of the body 12. The piston 36 in turn compresses the air within the longitudinal bore 26 toward the front end 12F of the body 12 driving the compressed air through the aperture 40 into the first recess 30 and through the longitudinal air tunnel 48 toward the second recess 46 to eject a projectile positioned on the elongate projectile shaft 16 or in either of the first recess 30 or the second recess 46.

Referring now to FIG. 10A, FIG. 10B, FIG. 10C, FIG. 11, and FIG. 16, in conjunction with FIG. 14, the first recess 30 of the piston tube 32 comprises a threaded member 50 protruding outwardly from the first end 32A of the piston tube 32 and into the cavity 28 of the body 12. The threaded member 50 includes a circumference which defines the first recess 30. The threaded member 50 threadably engages the proximal end 16P of the elongate projectile shaft 16. The proximal end 16P of the elongate projectile shaft 16 includes a complimentary threaded recess 52 that threadably engages the threaded member 50. The cavity 28 includes a wall 54 defining a gap 56 between the cavity 28 and the threaded member 50. The proximal end 16P of the projectile shaft 16 comprises an annular collar 58, which stops a projectile in position along the length of the projectile shaft 16 when mounting the projectile thereon. The gap 56 provides a space that enables the collar 58 to turn into as the threaded recess 52 threadably engages the threaded member 50 at the front end 12F of the body 12. The second recess 46 includes a stop shoulder 60 to prevent a projectile from entering the longitudinal air tunnel 48 when the projectile is inserted into the second recess 46.

Referring now to FIG. 2A, FIG. 2B, FIG. 3A, FIG. 3B, FIG. 4, FIG. 9A, FIG. 9B, FIG. 12A, FIG. 12B, FIG. 13A, FIG. 13B, FIG. 15, FIG. 17, and FIG. 18, the toy projectile launching assembly 10 comprises a first spherical projectile 62, a second elongate projectile 64, and a third elongate projectile 66. The first spherical projectile 62 includes a fourth diameter that is substantially equal to the first diameter of the first recess 30 such that the first spherical projectile 62 may fit within the first recess 30 of the front end 12F of the body 12, such as with an interference or friction fit. The second elongate projectile 64 includes a body 68 having third length and a cylindrical bore 70 including a fifth diameter. The fifth diameter is substantially equal to the second diameter of the elongate projectile shaft 16 such that the cylindrical bore 70 may fit over the length of the elongate projectile shaft 16, such as with an interference or friction fit. The second elongate projectile 64 may include a proximal end 64P including fletching 65 and a distal 64D opposite the proximal end 64P that includes an arrowhead 67 having a whistle 69. The cylindrical bore 70 extends inward of the proximal end 64P.

The third elongate projectile 66 includes a body 72 including a fourth length, a sixth diameter, and cylindrical bore 74. The sixth diameter is substantially equal to the third diameter of the second recess 46 such that the third elongate projectile 66 may fit within the second recess 46 of the distal end 16D of the elongate projectile shaft 16, such as with an interference or friction fit. The cylindrical bore 74 receives compressed air from the longitudinal air tunnel 48 when the spring biased plunger 14 is released from an extended position to aid in ejecting/launching the third elongate projectile 66 from the elongate projectile shaft 16. The fourth length of the third elongate projectile 66 is less than the third length of the second elongate projectile 64.

In one operation of the toy projectile launching assembly 10, a user threadably disengages the elongate projectile shaft 16 from the front end 12F of the body to expose the first recess 30. Once the first recess 30 is exposed, a user may insert the first spherical projectile 62 inside of the first recess 30 and actuate the spring-biased plunger 14 to eject/launch the first spherical projectile 62 from the front end 12F of the body 12. To use the second elongate projectile 64 and a third elongate projectile 66, the user threadably engages the elongate projectile shaft 16 with the front end 12F. Once engaged, a user may either slide the second elongate projectile 64, via the cylindrical bore 70 thereof, over the elongate projectile shaft 16 to the proximal end 16P or insert the third elongate projectile 66 inside of the second recess 46 to the stop shoulder 60. In this way, either of the second elongate projectile 64 or the third elongate projectile 66 may be ejected/launched from the elongate projectile shaft 16 by actuation of the spring-biased plunger 14.

Referring now to FIG. 5, FIG. 6, FIG. 7, and FIG. 8, in conjunction with FIG. 1 and FIG. 14, the projectile holder 18 protrudes outwardly from the top end 12T of the body 12. The projectile holder 18 includes a proximal end 18P attached to the top end 12T, a distal end 18D including an upper arm bracket 76 protruding upwardly therefrom that is attached to the upper arm 20, and projectile receiving apertures 78 disposed between the proximal end 18P and the distal end 18D. The projectile receiving apertures 78 include a diameter substantially equal to the fourth diameter of first spherical projectile 62 such that the projectile receiving apertures 78 may receive and sustain the first spherical projectile 62 therein such as with an interference or friction fit. In embodiments, the upper arm bracket 76 includes a mounting brace 80 including an opening having a scope 82 mounted therethrough. The mounting brace 80 protrudes downwardly from the upper arm bracket 76 and is affixed to the distal end 18D of the projectile holder 18. The mounting brace 80 is positioned between the projectile holder 18 and the upper arm 20 such the scope 82 is disposed between the upper arm bracket 76 and the distal end 18D of the projectile holder 18. The upper arm bracket 76 includes first mounting members 84 protruding outwardly therefrom that removably receive the upper arm 20.

The grip handle 22 protruding outwardly from the bottom end 12B of the body 12. The grip handle 22 includes a proximal end 22P, a distal end 22D, and an ergonomic handle body 22B extending between the proximal end 22P and the distal end 22D. The ergonomic handle body 22B mimics a gun handle in terms of shape and size. The ergonomic handle body 22B includes a trigger aperture 86 at the proximal end 22P to enable a user to place a finger therethrough for purposes of gripping the toy projectile launching assembly 10 and mimicking a trigger. The distal end 22D includes a lower arm bracket 88 attached to the lower arm 24. The lower arm bracket 88 also includes second mounting members 90 protruding outwardly therefrom that removably receive the lower arm 24.

The upper arm 20 includes a proximal end 20P and a distal end 20D opposite the proximal end 20P. The proximal end 20P is connected to the upper arm bracket 76 and includes first mounting apertures 92 for removably receiving the first mounting members 84 of the upper arm bracket 76. The distal end 20D of the upper arm 20 includes a first elastic element 94 connecting the distal end 20D to an upper end of the draw handle 42 of the plunging rod 32 of the spring-biased plunger 14. The lower arm 24 includes a proximal end 24P and a distal end 24D opposite the proximal end 24P. The proximal end 24P is connected to the grip handle 22 and includes second mounting apertures 96 for removably receiving the second mounting members 90 of the lower arm bracket 88. The distal end 24D of the lower arm 24 includes a second elastic element 98 connecting the distal end 24D to a lower end of the draw handle 42 of the plunging rod 32 of the spring-biased plunger 14. In embodiments, the upper arm 20, the lower arm 24, and the body 12 are coplanar with respect to each other. In some embodiments, the projectile holder 18, the upper arm 20, the upper arm bracket 76, the lower arm 24, the lower arm bracket 88, the scope 82, and the body 12 are coplanar with respect to each other.

The first elastic element 94 and the second elastic element 98 are coplanar with respect to each other. The first elastic element 94 and the second elastic element 98 are simultaneously deformable when the plunging rod 32 is extended out of the longitudinal bore 26. When deformed, the first elastic element 94 and the second elastic element 98 form an elastic potential energy on the plunging rod 32 such that when the plunging rod 32 is released from an extended position the first elastic element 94 and the second elastic element 98 exert a force on the plunging rod 32 that helps drive the plunging rod 32 through the body 12.

In embodiments, the upper arm 20 includes a second projectile holder 100 disposed between the proximal end 20P and the distal end 20D. The second projectile holder 100 includes a recess 102 having a diameter substantially equal to the fifth diameter of the second elongate projectile 64 to fit the second elongate projectile 64 therein, such as with an interference or friction fit. The lower arm 24 includes a third projectile holder 104 disposed between the proximal end 24P and the distal end 24D. The third projectile holder 104 includes a recess 106 having a diameter substantially equal to the sixth diameter of the third elongate projectile to fit the third elongate projectile 66 therein, such as with an interference or friction fit.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a three-in-one toy projectile launching assembly. The disclosure is illustrated by example in the drawing figures, and throughout the written description. It should be understood that numerous variations are possible, while adhering to the inventive concept. Such variations are contemplated as being a part of the present disclosure.

What is claimed is:

1. A toy projectile launching assembly for launching different types of toy projectiles, comprising:

a bow structure including a body having a longitudinal bore extending along a longitudinal axis of the body, a spring-biased plunger extendable relative to the longitudinal bore, and a first recess including a first diameter, the first recess in communication with the longitudinal bore; and an elongate projectile shaft removably attachable to the body, the elongate projectile shaft including a second diameter, a first length, and a second recess, the second recess including a third diameter and a second length, the second diameter larger than the third diameter, the first length larger than the second length, the elongate projectile shaft further including a longitudinal air tunnel extending along a longitudinal axis of the projectile shaft, the longitudinal air tunnel in communication with the first recess and the second recess;

a first spherical projectile including a fourth diameter, the spherical projectile configured to friction fit within the first recess;

a second elongate projectile including a third length and a cylindrical bore including a fifth diameter, the second elongate projectile configured to friction fit over the elongate projectile shaft; and a third elongate projectile including a fourth length and a sixth diameter, the fourth length less than the third length, the third elongate projectile configured to friction fit within the second recess;

wherein when the spring-biased plunger is released from an extended position, the spring-biased plunger compresses air within the longitudinal bore driving compressed air to the first recess and through the longitudinal air tunnel to the second recess to eject a projectile positioned on the elongate projectile shaft, in the first recess, or in the second recess.

2. The toy projectile launching assembly of claim 1, wherein the body of the bow structure further includes a cavity including the first recess, a top end, a bottom end, the top end opposite the bottom end, a front end, a rear end, the front end opposite the rear end, the longitudinal bore extending along the longitudinal axis of the body from the front end to the rear end, the spring-biased plunger forming an elastic potential energy toward the front end of the body.

3. The toy projectile launching assembly of claim 2, wherein the spring-biased plunger is slidably disposed within the longitudinal bore, the spring-biased plunger extendable out of the longitudinal bore to form an elastic potential energy toward the front end of the body, the spring-biased plunger sliding within the longitudinal bore toward the front end of the body when released from the extended position thereby compressing air within the longitudinal bore toward the front end of the body and driving the compressed air to the first recess and through the longitudinal air tunnel to the second recess.

4. The toy projectile launching assembly of claim 3, wherein:

the spring-biased plunger comprises a plunging rod slidably disposed within the longitudinal bore, the plunging rod extendable out of the longitudinal bore via the rear end of the body, a spring disposed around the plunging rod, the plunging rod including a plunging end disposed within the longitudinal bore and an extending end protruding outwardly from the rear end of the body, the plunging end opposite the extending end, the plunging end including a piston operably coupled to the spring, the extending end including a draw handle for extending the plunging rod out of the longitudinal bore of the body, the spring biased toward the front end of the body such that as the plunging rod is extended out of the longitudinal bore the piston deforms the spring toward the rear end of the body forming the elastic potential energy, the elastic potential energy increasing the further the plunging rod is extended out of the longitudinal bore; and when the spring-biased plunger is released from an extended position, the plunging rod drives the piston toward the front end of the body, the piston compressing the air within the longitudinal bore toward the front end and driving the compressed air to the first recess and through the longitudinal air tunnel to the second recess to eject a projectile positioned on the elongate projectile shaft or in either of the first recess or the second recess.

5. The toy projectile launching assembly of claim 4, comprising a piston tube affixed within the longitudinal bore of the body, the plunging rod and the spring each disposed within the piston tube, the piston tube including a first end adjacent to the front end of the body, a second end adjacent to the rear end of the body, and a circumference, the first end of the piston tube including the first recess, the piston coextensive with the circumference of the piston tube.

6. The toy projectile launching assembly of claim 5, wherein the first recess of the piston tube comprises a threaded member protruding outwardly from the first end into the cavity of the body, the threaded member configured to threadably engage the proximal end of the elongate projectile shaft.

7. The toy projectile launching assembly of claim 6, wherein the cavity of the body includes a wall defining a gap between the cavity and the threaded member, the gap enabling the proximal end of the projectile shaft to threadably engage the threaded member.

8. The toy projectile launching assembly of claim 6, wherein the proximal end of the projectile shaft includes a threaded recess configured to threadably engage the threaded member.

9. The toy projectile launching assembly of claim 6, wherein the proximal end of the projectile shaft comprises an annular collar configured to stop the second elongate projectile in position along the length of the projectile shaft when mounting the second elongate projectile thereon.

10. The toy projectile launching assembly of claim 4, further comprising a bow-shaped upper arm protruding outwardly from the top end of the body and a bow shaped lower arm protruding outwardly from the bottom end of the body, the upper arm including a proximal end and a distal end opposite the proximal end, the lower arm including a proximal end and a distal end opposite the proximal end, each of the upper arm, the lower arm, and the body coplanar with respect to each other.

11. The toy projectile launching assembly of claim 10, further comprising a first elastic element connecting the distal end of the upper arm to the draw handle of the plunging rod and a second elastic element connecting the distal end of the lower arm to the draw handle of the plunging rod, the first elastic element and the second elastic element simultaneously deformable when the plunging rod is extended out of the longitudinal bore thereby forming an elastic potential energy when the plunging rod is extended out of the longitudinal bore that is exerted onto the plunging rod when the plunging rod is released from an extended position.

12. The toy projectile launching assembly of claim 11, wherein:

the upper arm includes a first projectile holder disposed between the proximal end and the distal end of the upper arm, the first projectile holder including a recess having a diameter substantially equal to the fifth diameter of the second elongate projectile to fit the second elongate projectile therein;

the lower arm includes a second projectile holder disposed between the proximal end and the distal end of the lower arm, the second projectile holder including a recess having a diameter substantially equal to the sixth diameter of the third elongate projectile to fit the third elongate projectile therein; and a third projectile holder protrudes outwardly from the top end of the body, the third projectile holder including a proximal end attached to the top end, a distal end including a first bracket attached to the upper arm, and an aperture disposed between the proximal end and the distal end, the aperture including a diameter substantially equal to the fourth diameter of the first spherical projectile to fit the first spherical projectile therein.

13. The toy projectile launching assembly of claim 12, further comprising a grip handle protruding outwardly from the bottom end of the body, the grip handle including a proximal end including an aperture for placing a finger therethrough and a distal end including a second bracket attached to the lower arm.

14. The toy projectile launching assembly of claim 13, wherein:

the first bracket includes a protrusion extending outwardly therefrom and the proximal end of the upper arm includes an aperture for removably receiving the protrusions of the first bracket; and the second bracket includes a protrusion extending outwardly therefrom and the proximal end of the lower arm includes an aperture for removably receiving the protrusions of the second bracket.

15. The toy projectile launching assembly of claim 1, wherein the elongate projectile shaft further includes a proximal end, a distal end, the proximal end opposite the distal end, the proximal end removably attachable to the first recess of the body, the distal end includes the second recess, the second recess extends inwardly along a longitudinal axis of the elongate projectile shaft, and the longitudinal air tunnel extends along the longitudinal axis of the elongate projectile shaft from the proximal end to the distal end.

16. The toy projectile launching assembly of claim 1, wherein the fourth diameter of the first spherical projectile is substantially equal to the first diameter of the first recess.

17. The toy projectile launching assembly of claim 1, wherein the fifth diameter of the cylindrical bore of the second elongate projectile is substantially equal to the second diameter of the elongate projectile shaft.

18. The toy projectile launching assembly of claim 1, the fourth length of the third elongate projectile is less than the third length of the second elongate projectile and the sixth diameter of the third elongate projectile is substantially equal to the third diameter of the second recess such that the third elongate projectile is configured to fit within the second recess.

19. The toy projectile launching assembly of claim 1, wherein the third diameter is larger than a diameter of the longitudinal air tunnel.

20. The toy projectile launching assembly of claim 1, wherein the second recess includes a stop shoulder to prevent the third elongate projectile from entering the longitudinal air tunnel when inserting the third elongate projectile therein.

* * * * *